US005123835A

United States Patent [19]

Richards et al.

[11] Patent Number: 5,123,835

[45] Date of Patent: Jun. 23, 1992

[54] PULSE COMBUSTOR WITH CONTROLLABLE OSCILLATIONS

[75] Inventors: George A. Richards, Morgantown, W. Va.; Michael J. Welter, Columbiana, Ohio; Gary J. Morris, Morgantown, W. Va.

[73] Assignee: The United States of America as represented by the United States Department of Energy, Washington, D.C.

[21] Appl. No.: 663,348

[22] Filed: Mar. 4, 1991

[51] Int. Cl.[5] ..... F23C 11/04

[52] U.S. Cl. ..... 431/1; 431/160; 431/347; 122/24; 60/39.76

[58] Field of Search ..... 431/1, 160, 347; 122/24; 60/39.76, 39.77, 39.8

[56] References Cited

U.S. PATENT DOCUMENTS

| | | | |
|---|---|---|---|
| 1,414,099 | 4/1922 | Sirouet | 431/1 |
| 2,644,512 | 7/1953 | Durr et al. | 431/1 |
| 3,143,160 | 8/1964 | Rydberg | 122/24 |

FOREIGN PATENT DOCUMENTS

| | | | |
|---|---|---|---|
| 30901 | 2/1985 | Japan | 431/1 |
| WO82/00702 | 3/1982 | World Int. Prop. O. | 431/1 |

OTHER PUBLICATIONS

"Advanced Combustion Techniques", Proceedings of 6th Annual Coal-Fueled Heat Engines & Gas Cleanup Systems, G. A. Richards et al, DOE/METC-89/6101 (1989) pp. 142-152.

"Atomization of Coal Water Slurry Using a Pulse Combustor", American Flame Research Committee 1989 Symposium on Combustion in Industrial Furnaces, D. W. Shaw et al, Paper #22 Sep. 25-27, 1989.

"Advanced Pulse Combustion", 7th Annual Coal-Fueled Heat Engines and Gas Stream Cleanup Systems, G. A. Richards et al Abstract, Mar. 26-28, 1990, p. 7.

"Coal Water Slurry Atomization Using a Pulse Combustor", Proceedings of the Spring Technical Meeting, Central States Section, Combustion Institute, Cincinnati, Ohio, Shaw et al (1990) pp. 379-384.

"Pulse Combustion Lowers Drying Cost", Chemical Engineering, J. Chowdury, Dec. 10, 1984, pp. 44-45.

"Acoustic Burner Saves Liquid Fuel in an Industrial Furnace", Energy Progress 8:2, K. M. Swamy et al, Jun. 1988, pp. 118-120.

"A Pressure-Gain Combustor Utilizing Twin Valveless Pulsed-Combustors Operating in Anti-Phase", Amerian Chemical Society, V. 2, J. A. C. Kentfield et al, Aug. 5-9, 1979, pp. 1774-1779.

"Applications of Acoustics in Advanced Energy Systems", ASME, G. A. Richards et al, 89-WA/NCA-3, Dec. 10-15, 1989, Paper pp. 1-8.

"Guidelines for Design of Pulse Combustion Devices, Particularly Valveless Pulse Combustors", R. M. Lockwood Proceedings of Symposium on Pulse-Combustion Applications V. 1, Mar. 2-3, 1982, NTIS PB82-240060, pp. 14-1 to 14-24.

"A Large Amplitude Oscilating Combustor", Proceedings of ASME Energy Sources Technology Conference and Exhibition, G. J. Morris et al, (1989) Paper pp. 1-3.

Advanced Research and Technology Development Direct Utilization and Diagnostics Contractors Review Meeting, G. A. Richards et al, Oct. 3-5, 1989 Abstract p. 1.6.

*Primary Examiner*—James C. Yeung

*Attorney, Agent, or Firm*—David E. Breeden; Stephen D. Hamel; William R. Moser

[57] ABSTRACT

A pulse combustor having thermally induced pulse combustion in a continuously flowing system is described. The pulse combustor is fitted with at lease one elongated ceramic body which significantly increases the heat transfer area in the combustion chamber of the combustor. The ceramic body or bodies possess sufficient mass and heat capacity to ignite the fuel-air charge once the ceramic body or bodies are heated by conventional spark plug initiated combustion so as to provide repetitive ignition and combustion of sequentially introduced fuel-air charges without the assistance of the spark plug and the rapid quenching of the flame after each ignition in a controlled manner so as to provide a selective control over the oscillation frequency and amplitude. Additional control over the heat transfer in the combustion chamber is provided by employing heat exchange mechanisms for selectively heating or cooling the elongated ceramic body or bodies and/or the walls of the combustion chamber.

9 Claims, 4 Drawing Sheets

PULSE COMBUSTOR WITH CONTROLLABLE OSCILLATIONS

BACKGROUND OF THE INVENTION

The present invention relates generally to a pulse combustor for providing an oscillating stream of hot combustion products, and more particularly to a pulse combustor arrangement in which the frequency and amplitude of the oscillations are selectively controllable.

Pulse combustors have been found to be valuable as mechanisms for providing sonic streams of hot gases which can be utilized in various applications such as drying, smelting, water heating, and vortex heaters Also, the sonic energy or sound waves accompanying the hot gases as provided by the cyclic combustion process inherent in pulse combustors provides for efficient slurry atomization and the dispersion of fluids, liquids, and powders.

Pulse combustors are of relatively simple construction and generally comprise a combustion chamber with fuel and air supply systems and a spark plug for effecting the ignition of the fuel-air mixture. An exhaust nozzle, which may be acoustically tuned, is attached to the combustion chamber through a tapered flange for conveying the sonic streams of the hot combustion gases to a point of use. The combustion process is initiated when a charge of air and fuel is introduced into the combustion chamber and ignited by the spark plug. The burning of the gases occurs rapidly and causes the pressure of the gases to rise in the combustion chamber. This pressure increase results in the combustion gases quickly exiting the combustion chamber through the exhaust opening at very high velocities. As the pressure falls in the combustion chamber after an explosive event, another charge of fuel and air is introduced into the combustion chamber to repeat the cycle. This cyclic combustion process is continuous with the rate of oscillation depending upon the particular geometry of the combustion chamber, fuel-air input rates, and the ignition system utilized. The rapid combustion of the fuel-air mixture provides a flow of hot gases from the combustor through the nozzle with these gases oscillating at various amplitudes and frequencies depending upon the operating parameters within the combustor.

Generally, pulse combustors have been found to be very versatile and can use almost any fuel capable of being delivered through a conduit such as liquid fuels including fuel oil, diesel oil, alcohols, as well as gaseous fuels such as natural gas and propane. Also, oil- or coal-water slurries may be used as the fuel in the combustors.

The pulse combustors as presently known include the valveless type where the air supply is introduced into the combustion chamber through self aspiration via an essentially open front end, the valved type which utilize a flapper valve which opens and closes during each cycle to provide the combustion supporting air, and another type of valveless pulse combustor where the front end of the combustor is closed and the air is introduced into the combustion chamber in a suitable manner from a pressurized source. The operation of the combustors using a compressed air supply arrangement is advantageous since it has the better control features of the aforementioned types of combustors particularly due to the fact that the fuel-air ratios and the throughput or flow time for the reactants may be selectively varied to provide a greater measure of control over the frequency and amplitude of the combustion oscillations.

Such control over the frequency and amplitude of the oscillations is desirable where the high-velocity pulsations from the combustor are to be utilized for slurry atomization or as a particulate dispersing mechanism. In such instances high amplitude oscillations at high frequencies are believed to be particularly desirable.

However, there are some problems attendant with providing and maintaining a suitable level of control over the amplitude and frequencies provided by the oscillating combustors as presently known. These problems or shortcomings are primarily due to the discovery that heat transfer within the combustion zone was found to be significant in the control of the combustion oscillation amplitude and frequency. Most notably is the temperature of the combustor walls in that as the wall temperature increases during the operation, the oscillating frequency also increases while the oscillating amplitude decreases. In fact, the frequency continually increases to such a point with increasing wall temperatures that an essentially steady flame eventually replaces oscillations of any significance in the combustor.

With the operating frequency increasing with increasing wall temperatures, the combustor wall temperature and the oscillating pressure are directly related. At fixed throughputs or flow times of fuel and air, the pressure of the oscillations decreases with increasing wall temperature. Thus, any increase in wall temperature is also accompanied by an increase in frequency with the pressure or amplitude being inversely related to the frequency. In previous demonstrations of thermally induced pulse combustion devices, the higher wall temperatures produced pulses at higher frequencies and lower amplitudes. It is important to realize that in order to generate oscillations in a pulse combustor, it is required that the flame be nearly extinguished within the combustor after each explosion so as to provide a defined, sharp pulse or pressure spike in the oscillation. The more rapid the extinguishing of the flame after the thermal explosion the greater the amplitude and also frequency of the oscillation.

Efforts to regulate the oscillating frequency of pulse combustors included varying the air-fuel ratio or equivalence ratio and increasing the throughput by using lower flow times where the fuel and air are introduced into the combustion chamber from pressurized sources. Convective heat transfer from the high temperature walls promoted reignition of the fuel-air mixture so that it was expected that an increase in the throughput would effect the heat transfer rate since the higher mass flow would require more heat to raise the temperature to the ignition temperature. Thus, given a fixed heat transfer area such as provided by the combustor walls and assuming that the local reactions near the spark plug would not be significantly affected by the changes in the flow times, the higher throughputs provided some control over the oscillations. However, it was still found that further heating of the walls defining the combustion zone occurred even with the higher throughputs so as to result in an increase in the frequency with lower pressures.

SUMMARY OF THE INVENTION

Accordingly, it is a primary objective or aim of the present invention to provide a pulse combustor with an improved heat transfer arrangement capable of producing explosive conditions in the combustion chamber and then providing for the rapid extinction of the flame after each explosion. Generally, the combustor of the present invention comprises a longitudinally extending housing means having side walls and opposite end wall portions defining a combustion chamber. Tailpipe means or discharge means are coupled to the housing means and are in registry with the combustion chamber through an opening in one of the end wall portions. Fuel inlet means and air inlet means are coupled to the housing means and in registry with the combustion chamber for cyclicly charging the combustion chamber with a mixture of fuel and air at a preselected equivalence ratio and flow time. Ignition means are carried by the housing means for sequentially igniting the cyclic charges of the fuel and air for providing oscillating uses of combustion gases through the discharge means. Means are disposed within the combustion chamber for substantially increasing the heatable surface area of the combustion chamber and comprise a material possessing sufficient heat capacity to serially effect upon sufficient heating thereof by cyclic combustion of the air-fuel mixture ignition of subsequent sequential charges of the fuel and air and the quenching of the resulting combustion of each charge of the fuel and air at a rate adequate to provide oscillating pulses of combustion gases through the discharge means at a substantially preselected amplitude and frequency.

In accordance with the present invention the means disposed in the combustion chamber for substantially increasing the heatable surface of the combustion chamber is provided by positioning one or more longitudinally extending, rod-shaped bodies in the combustion chamber. The elongated body or bodies are heated sufficiently to establish and maintain local reactions such as observed near the spark plug during the combustion operation prior to the formation of deleteriously high wall temperatures and also provides for sufficient transfer of heat from the resulting explosion to the ceramic body or rod to rapidly quench or extinguish the flame so as to provide high frequency, high amplitude oscillations. To effect this two-fold ignition and flame quenching feature of the present invention, the elongated body or bodies are each formed of a refractory or ceramic material having sufficient mass and heat capacity to be adequately heated during the combustion process to regenerate heat into the issuing air and fuel charge such as provided by the hot combustion chamber walls to sufficiently heat the air and fuel charge to ignition temperature and then sufficiently absorbing heat from the explosive flame to rapidly extinguish the flame. Also, the elongated body or bodies may incorporate a heat transfer mechanism for providing and maintaining the elongated body or bodies at a selected temperature. Thus, by employing one or more ceramic bodies of a selected mass and material, high amplitude oscillations at high frequency may be established and maintained indefinitely in a manner considerably different from that previously available in pulse combustors This continuous operation may be maintained without further use of a spark plug after the ceramic body is heated to a temperature sufficient to ignite the charges of the fuel and air. The selection of the heat capacity and the mass of the material used for the body or bodies are dependent upon the particular configuration of the combustor as well as the type of fuel used since different fuels require different temperatures for effecting the ignition thereof.

A further control over the oscillation amplitude and frequency of the pulse combustor containing one or more ceramic bodies is achieved by providing the walls of the combustion chamber and/or the ceramic body or bodies with a heat exchange or heat transfer arrangement. For example. the placing of an annular chamber around the combustion chamber walls and then circulating a fluid or liquid through the annular chamber to selectively cool or heat the combustion chamber walls to a desired temperature. The ceramic body or bodies may be provided with a central bore or another suitable passageway to provide for the cooling or heating of the ceramic body or bodies with a fluid or liquid. The selective heating or cooling of the combustion chamber walls and/or the ceramic body or bodies provide a mechanism by which the temperature within the combustion chamber and that of the ceramic body or bodies due to heat transfer from the combustion chamber walls can be regulated to provide for even further control over the amplitude and frequency of the oscillations.

In the present invention, the use of one or more elongated ceramic bodies with a selected throughput provides a pulse combustor in which the amplitude and the frequency of the oscillation maintainable by the pulse combustor may be tailored for use in particular applications such as providing oscillations at high frequency and high amplitude which are particularly desired for slurry atomization.

Other and further objects of the present invention will become obvious upon an understanding of the illustrative embodiment about to be described and will be indicated in the appended claims and various advantages not referred to herein will occur to one skilled in the art upon employment of the invention in practice.

Preferred embodiments of the present invention have been chosen for the purpose of illustration and description. The preferred embodiments are not intended to be exhaustive nor to limit the invention to the precise forms disclosed. They are chosen and described in order to best explain the principles of the invention and their application and practical use to thereby enable others skilled in the art to best utilize the invention in various embodiments and modifications that are best adapted to a particular use contemplated.

DETAILED DESCRIPTION OF THE INVENTION

The present invention is directed to pulse or oscillating combustors capable of providing and maintaining heat transfer controlled oscillations in a continuously flowing arrangement which is particularly suitable for producing selected amplitude pressure pulses or oscillations in a range of about 0 to 200 kPa while maintaining oscillations at essentially a selected frequency in a range of about 20 to 120 Hz.

Figures 1, 1A:
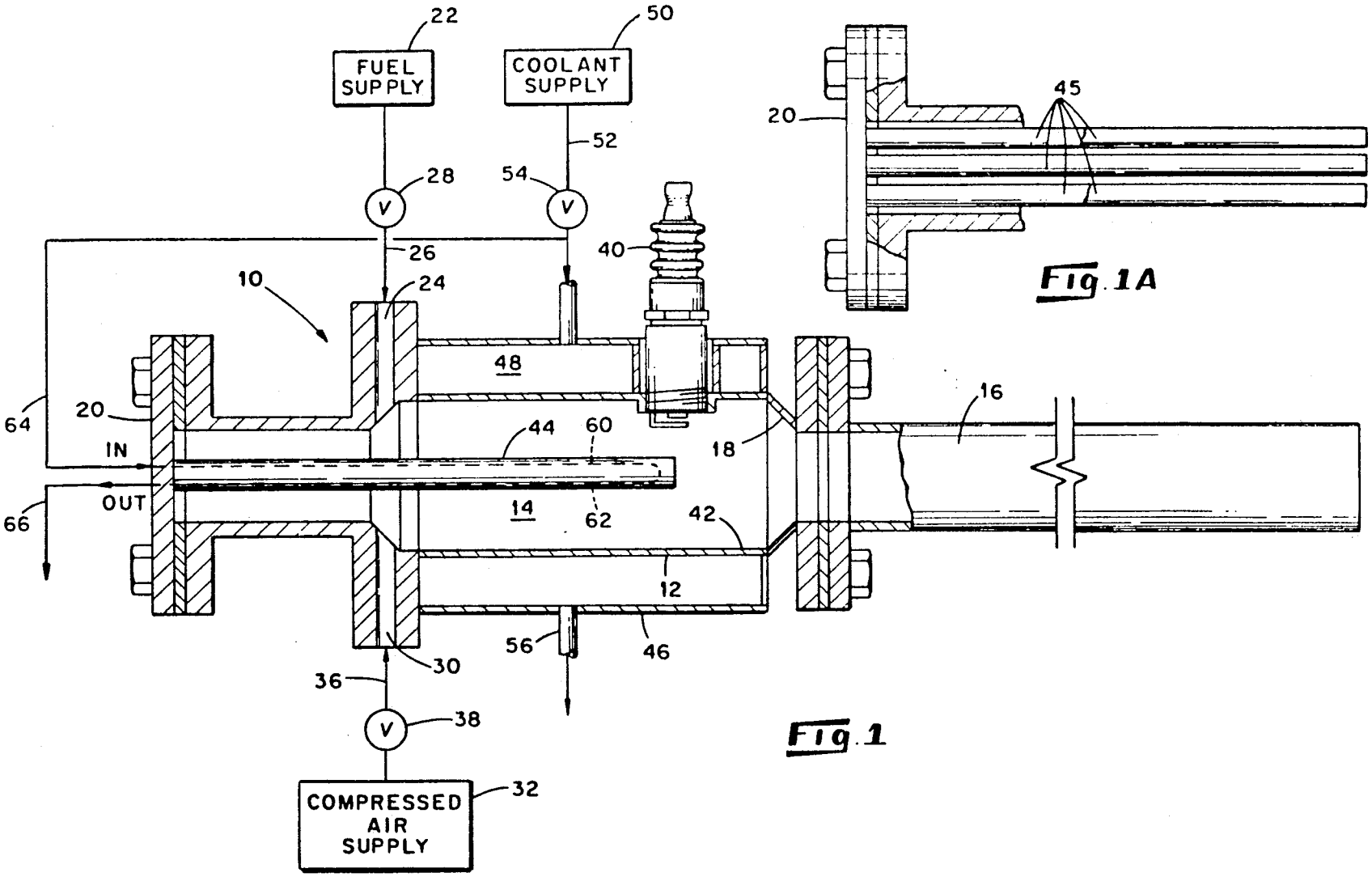
FIG. 1 is a sectional view showing a pulse combustor containing both a centrally located elongated ceramic body having a heat exchange mechanism associated therewith for providing a high level of control over the pressure and frequency of the oscillations of the combustor and a heat exchange jacket disposed around the outer surface of the combustion chamber walls for providing an even further level of control over the operating parameters of the pulse combustor.
FIG. 1*a* is a sectional view of a further embodiment showing a plurality of elongated ceramic bodies longitudinally extending into the combustor.

With particular reference to FIG. 1 of the drawings, a pulse combustor is generally shown at 10 and comprises a cylindrical housing 12 defining an elongated combustion zone or combustion chamber 14. The housing 12 is coupled at one end thereof to an exhaust duct or tailpipe 16 by a tapered transition flange or joint 18 as in conventional practice. The opposite longitudinal end of the combustion chamber 14 is closed by a wall or flange 20. A combustible fuel is introduced from a fuel supply 22 into the combustion zone 14 at a location near the closed end thereof through an inlet port 24. While only one fuel inlet port 24 is shown, it is to be understood that several circumferentially spaced apart fuel inlets are preferably utilized. The flow rate and volume of the fuel conveyed from a supply 22 into the combustion chamber 14 through line 26 is controlled by a suitable valving arrangement such as generally shown at 28. For the purpose of this description the fuel employed is propane, but it will appear clear that any fuel usable in pulse combustors, such as generally described above, can be used in the combustor of the present invention with the oscillations being controlled by the thermally induced pulse control of this invention as will be described below. Of course, the fuel ignition temperature, oscillations, transition temperatures, flow times, and the oscillating amplitudes and frequencies will vary from fuel to fuel. However, the heat transfer oscillation control as provided by the present invention is expected to be applicable with any usable fuel. In general terms, the formation of oscillations in the pulse combustor requires a source of heat to be present to develop the explosive conditions and the geometry or conditions within the combustor to assure flame extinction after the explosion.

Combustion supporting medium, preferably air, is introduced into the combustion chamber 14 through port 30 near the fuel inlet port 24. As with the fuel supply, several inlet ports 30 for the air are preferably circumferentially spaced about the combustion chamber 14. The air is shown provided by a compressed air supply 32 so that the volume and flow rate of the air introduced into combustion chamber 14 can be readily regulated. The air is conveyed from the air supply 32 through a conduit 36 containing a suitable flow control valve 38.

The flow of the fuel and air into the combustion chamber 14 through ports 24 and 30 is controlled by using valve-controlled pressurized fuel and air supplies whereby the equivalence ratio and flow time or throughput of the fuel and air into the combustion chamber 14 between explosive events can be readily varied and regulated. It has been found that using an equivalence ratio of air to fuel in a range of about 0.7 to 1.1 provides satisfactory results in the operation of the pulse combustor of the present invention using propane as the fuel. However, when using other fuels, such as described above, a different range of equivalence ratios may be desirable.

Ignition of the fuel and air mixture in the combustion chamber 14, at least during the early stages of the pulse combustor operation, is achieved by employing a suitable igniter preferably a spark plug as shown at 40. This spark plug 40 is positioned in a suitable location in the combustion chamber 14, preferably nearer the tailpipe 16 than to the fuel and air inlets 24 and 30. The spark from the spark plug 40 is preferably provided at a firing rate at least sufficient to assure that the desired oscillating frequency within the pulse combustor can be attained. A suitable spark plug operation can be provided by using a standard furnace ignition transformer connected to a standard 60 Hz, 110 voltage source so as to provide a repetitive plug firing at 120 Hz or about every 8 ms, which firing frequency is sufficient initiating and sustaining high frequency oscillations in the pulse combustor of the present invention.

A pulse combustor constructed as described above, i.e.. without the elongated ceramic body or bodies and wall heat exchange arrangement of the present invention and having a diameter of about 50 centimeters, a length of about 100 centimeters, and using propane as the fuel provided an oscillating combustion operation where the initial oscillating amplitude was about 200 kPa at a frequency of 20 Hz when operated with an equivalence ratio of 1.0 and a flow time of 74 ms. However, as this pulse combustor continued to operate the temperature of the combustor walls 42 increased to cause a corresponding decrease in the pressure of the oscillations and the increase in oscillation frequency. This decrease in amplitude and increase in frequency will continue until the walls 42 reach a transition temperature of about 64420 to 700° K. where the combustion will be essentially steady with an oscillating frequency substantially that of the Hemholtz frequency of the chamber, i.e. about 160 Hz with a low amplitude oscillation of about 25 kPa. At the transition temperature the walls 42 of the combustor were sufficiently hot to ignite the fuel-air mixture without the use of the spark plug.

Figure 2:
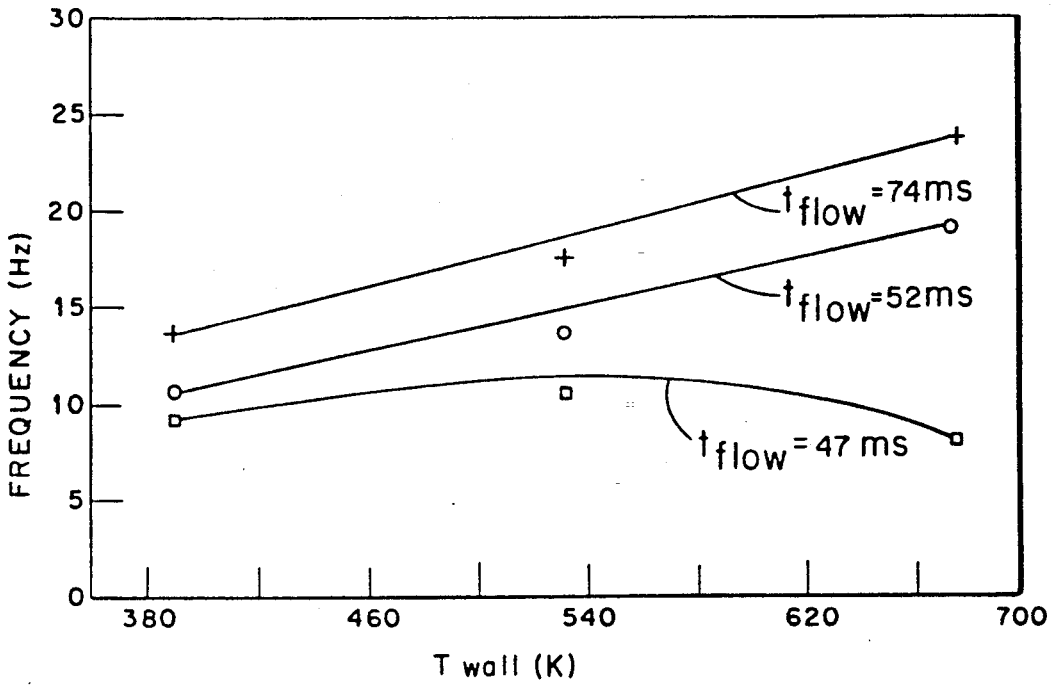
FIG. 2 is a graph illustrating the effect of wall temperature on the frequency of the oscillations in a previously known pulse combustor arrangement at throughputs of 47, 52, and 74 milliseconds with an air to fuel equivalence ratio of 1.0.
Figure 3:
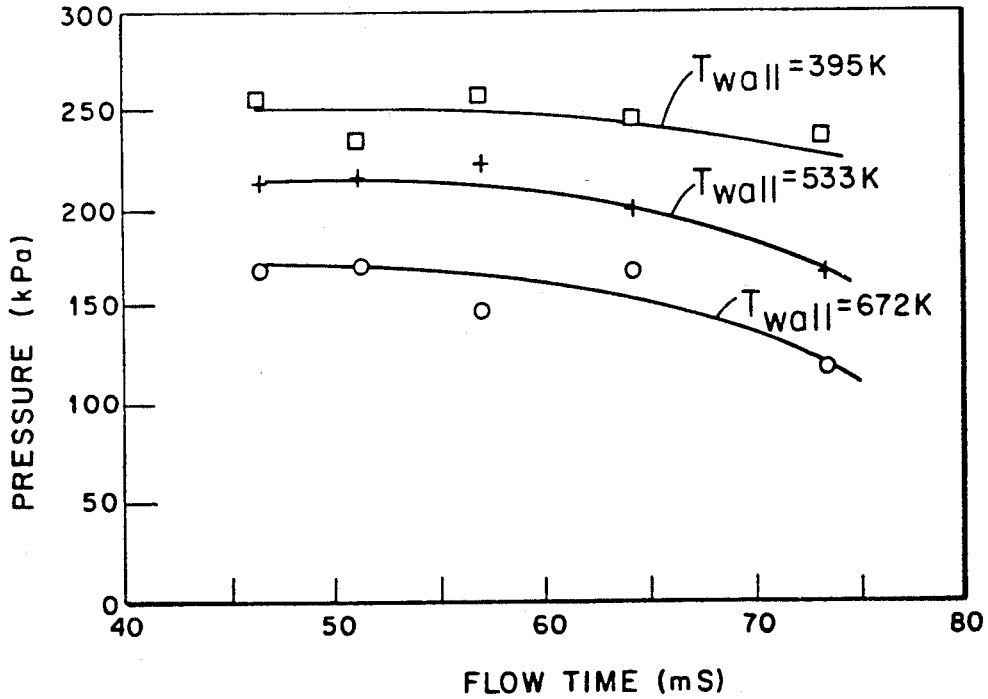
FIG. 3 is a graph illustrating the effect of wall temperature on the amplitude of the oscillations under conditions and flow rates similar to those illustrated in FIG. 2.

As shown in FIGS. 2 and 3 some control over the frequency and amplitude of the oscillations can be achieved while selectively increasing or decreasing the flow time of the fuel and air into the combustion chamber and by regulating the equivalence ratio. By increasing the throughput as provided by decreasing the flow time from 74 ms to 52 ms and then to 47 ms a degree of control was provided over increases in frequency as wall temperature increased, as shown in FIG. 2. However, as shown in FIG. 3, the pressure of the oscillations decreased with increasing wall temperature even with the several different flow times It has been found that after reaching the transition temperature oscillations can be restored by sufficiently increasing the flow rate to decrease the temperature of the gases to reestablish oscillations. Thus, with the pulse combustor, as described above and as generally known in the art, the wall temperature of the combustor is a dominant mechanism responsible for controlling the frequency of the oscillations since it is believed that the hot combustion chamber walls speed up the oscillations by heat transfer from the wall to the fuel air mixture with the frequency of oscillation increasing as the wall temperature increases.

In accordance with the present invention the pulse combustor as described above is provided with a heat transfer mechanism for thermally inducing cyclic combustion in a controlled and repetitive manner. With further reference to FIG. 1 of the drawing, the heat transfer area of the combustion chamber 14 is substantially increased by positioning an elongated body 44 of heat absorbing material in the combustion chamber 14. This body 44 is preferably of a rod or cylindrical shape and is supported by the end wall or flange 20 of the pulse combustor and cantileveredly extends into the combustion chamber 14 to a point generally adjacent to the spark plug 40. As shown in FIG. 1, this elongated body 44 is centrally located on the end wall 20 so as to extend into the combustion chamber 14 along the longitudinal axis thereof. This elongated body 44 is formed of a material having different heat capacities such as provided by the refractories and ceramics selected from alumina, fused silica, mullite, and zirconia. The particular ceramic material used as the elongated body 44 is preselected based upon its heat capacity for selectively tailoring the amplitude and oscillations achieved in the pulse combustor. Also, the mass of the ceramic body 44 is preselected to assure that sufficient heat transfer can be achieved from the ceramic body 44 to effect ignition of the fuel air charge and also possess an adequate mass to absorb sufficient heat from the explosive event to rapidly quench or extinguish the flame. Rapid quenching of the flame provides for an increase in frequency at a rate significantly greater in a pulse combustor with the ceramic body 44 than in a similarly constructed pulse combustor without the ceramic body 44.

The ceramic body 44 is initially heated by the cyclic combustion of the fuel-air mixture in the combustion chamber 14 by using the spark plug 40 as the ignition source. This initial heating of the ceramic body 44 may be aided by incorporating a heat exchange mechanism in the ceramic body 44 to selectively heat or cool the ceramic body 44. As shown in FIG. 1, the ceramic body is provided with a passageway 60 into which a fluid or liquid may be introduced via inlet 64 and discharged therefrom via passageway 62 to outlet 66. When the ceramic body 44 reaches a temperature of about 2000° F., the temperature of the ceramic body 44 is sufficient to effect ignition of the propane fuel. The temperature of the ceramic body 44 can ba maintained at this or any other desired temperature by the selective heating or cooling of the ceramic body. With the ceramic body 44 so heated, the heat transfer from the ceramic body 44 to the air and fuel mixture is sufficient to provide ignition of the fuel-air charges so as to eliminate the need for the spark plug 40. However, it may be desirable to continue to operate the spark plug 40 to assure operation of the combustor in the event of a flame out or if the temperature of the ceramic body 44 for some reason decreases to a level less than that sufficient to sustain ignition.

At each explosive event the gas temperature in the combustion chamber 14 reaches about 3000° F. when using propane as fuel. Heat in the gases resulting from the explosion is rapidly absorbed by the ceramic body 44 to immediately quench the flame before the high pressure gases are discharged through the tailpipe in the form of a sharp pressure Pulse. The more rapid this quenching and discharge of the gaseous products the higher the frequency can be achieved. Normally, except under some operating conditions, this ignition and flame quenching feature provided by the ceramic body 44 provides for relatively uniform and continuous cyclic operation of the pulse combustor at relatively high amplitudes and frequencies over prolonged periods without undergoing the aforementioned changes in oscillation frequency and amplitude due to increasing temperature of the combustion chamber walls. As illustrated in FIG. 1*a*, the single ceramic body 44 may be replaced with a plurality of elongated ceramic bodies 45 with each ceramic body 45 affixed to the end wall 20 and longitudinally extending into the combustion chamber 14. By employing a plurality of ceramic bodies 45 of selected diameter or mass, the ratio of the surface area to the volume of the combustion chamber can be readily tailored to provide a high level of control over the operational characteristics of the combustor While five ceramic bodies 45 are shown, it will appear clear that any desired number of ceramic bodies 45 may be used. Also, if desired these ceramic bodies 45 may be operatively associated with a heat exchange mechanism similar to that used for the single ceramic body 44 as shown in the FIG. 1 embodiment.

Figure 4:
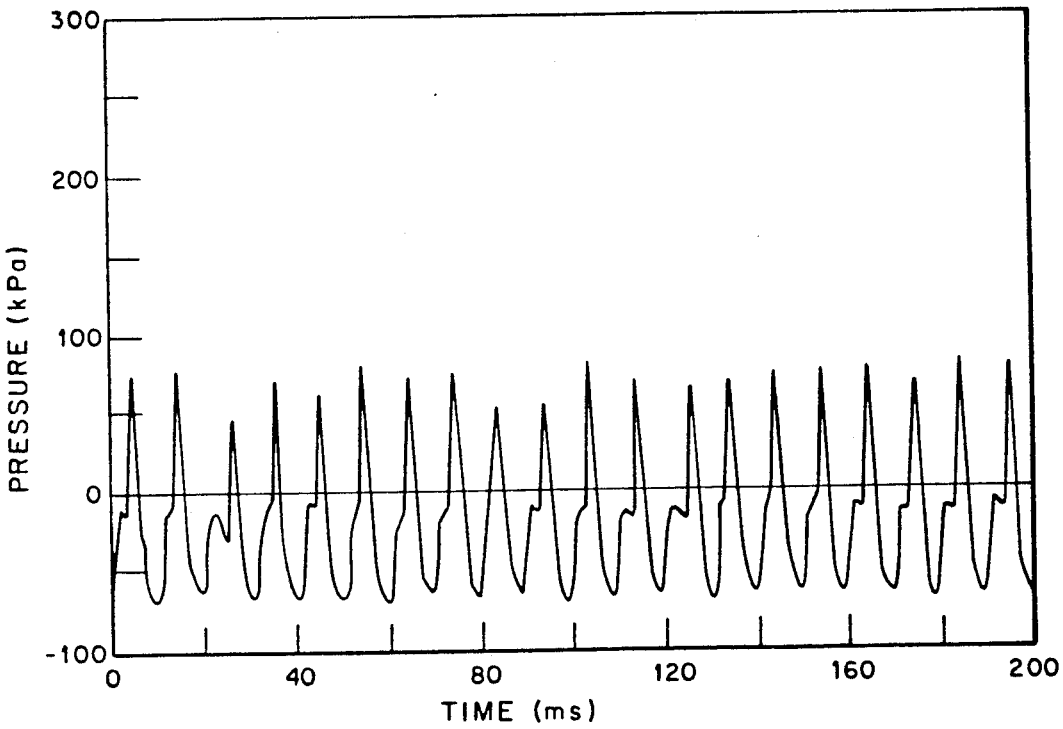
FIG. 4 is a graph showing a pressure trace in a pulse combustor operated at a flow rate of 33 ms and an equivalence ratio of 0.9 and fitted with alumina body or bodies in accordance with the present invention so as to provide an operating frequency of 104 Hz while maintaining relatively high pressure amplitude oscillations even at wall temperatures of 970° K.

With a pulse combustor having a 4.5 mm diameter and a single, high purity alumina body 44 centrally extending into the combustion chamber 14 and operating the pulse combustor with a flow time of 33 ms, an equivalence ratio of 0.9, and with the wall temperature of the combustor at 970° K. the combustor oscillated at a frequency of 104 Hz and a pressure of 135 kPa, such as shown in FIG. 4. This cyclic operation was repetitive and maintainable over a prolonged operating period without the use of the spark plug.

Figure 5:
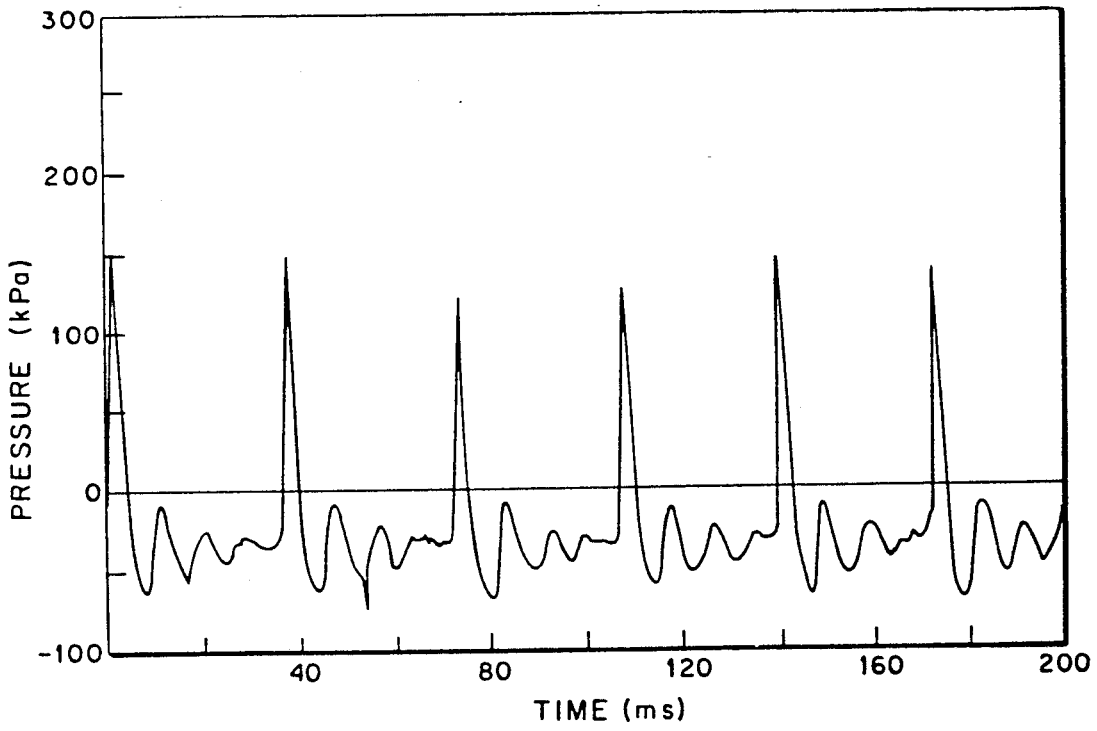
FIG. 5 is a graph illustrating the combustion pressure achieved at a operational frequency of 27 Hz with a previously known pulse combustor, i.e., a pulse combustor as used in providing the operational characteristics shown in FIG. 4 but without the body or bodies, having a wall temperature of 679° K. and a throughput of 23 milliseconds with an equivalence ratio of 0.9.

Conversely, without the ceramic body 44 and employing the same operating parameters but with the wall temperature at 690° K. (the wall temperature is a dependent variable determined by operational conditions) the pulse combustor operated at a frequency of 27 Hz with pressure spikes of about 200 kPa as shown in FIG. 5. Without the ceramic body 44 the spark plug was necessary to provide the ignition. Also, the wall temperature in the combustor without the ceramic body 44 continued to increase to cause a corresponding increase in the frequency and a decrease in the amplitude of the oscillations until the transition temperature was reached where an essentially amplitude-free steady state flame was present. Thus, the ceramic body 44 or the plurality of ceramic bodies 45 serve to increase the frequency while maintaining relatively high amplitude oscillations over prolonged operational periods.

To further tailor the control over the amplitude and frequency of the oscillations with the ceramic body 44 in place as in FIG. 1, a heat exchange mechanism is positioned contiguous to the walls 42 of combustion chamber to selectively cool or heat the walls 42 to a wall temperature desired for achieving a particular operation within the combustion chamber. By so cooling or heating the walls 42 the total heat transfer within the combustion chamber 14, as provided by the walls 42 and the ceramic body 44, can be readily varied so as to selectively regulate the operation of the pulse combustor. The cooling of the walls should not be to a temperature less than that which would allow sufficient heating of the ceramic body 44 or the plurality of ceramic bodies 45 as in FIG. 1*a*, to effect ignition of the fuel-air mixture without the use of a spark plug. By selectively cooling or heating the combustion chamber walls 42 the flow times and equivalence ratios may be varied to change oscillating frequencies and amplitudes without encountering problems such as would occur due to excessive wall heating in prior pulse combustion devices even when utilizing different flow times and equivalence ratios.

Suitable cooling or heating of the combustion chamber walls 42 may be achieved by providing an annular jacket 46 about the walls 42 in a spaced relationship thereto over essentially the full length of the combustion chamber 14 to form an annular fluid or liquid containing chamber 48 therebetween for receiving a wall cooling or heating fluid or liquid from a suitable supply such as generally indicated at 50. A conduit 52 with a suitable control valving arrangement 54 is provided to regulate the flow of the coolant or heating fluid or liquid into the jacket for selectively cooling or heating the combustion chamber walls 42. A discharge conduit 56 is attached to the jacket 46 so that an adequate throughput of the fluid or liquid can be provided through the annular chamber 48 to achieve the desired heating or cooling of the walls 42.

It will be seen that the present invention provides a readily controllable thermally induced pulse combustor operating as a continuously flowing system. The high frequency, high temperature spikes provided by the present invention are expected to be particularly advantageous for applications utilizing high pressure pulses such as the atomization of various slurries such as coal-water slurries and for enhancing several combustion processes where the high frequency sound waves from the combustor can be utilized to promote combustion such as in fluidized and fixed-bed combustors and the agglomeration of ash particulates for facilitating the separation of such particulates from the combustion gases discharged from the combustor. By using the ceramic body or bodies for heat removal, a satisfactory level of control over the emission of nitrous oxides can be realized.

What is claimed is:

1. A pulse combustor for providing oscillating pulses of combustion gases at selected frequencies and amplitudes, comprising in combination longitudinally extending housing means having side walls and opposite end wall portions defining a combustion chamber therein, discharge means coupled to one end wall portion of said housing means and disposed in registry with the combustion chamber through an opening in said one end wall portion, fuel inlet means and air inlet means coupled to said housing means and in registry with said combustion chamber for cyclicly charging said combustion chamber with charges of fuel and air at preselected equivalence ratios and flow times, ignition means carried by said housing means for sequentially igniting the cyclic charges of fuel and air for providing oscillating uses of combustion gasses through said discharge means, and at least one elongated ceramic body catileveredly supported by the end wall portion of the combustion chamber opposite to said discharge means and extending into said combustion chamber for substantially increasing the heatable surface area of said combustion chamber and with said at least one ceramic body being of a sufficient mass and possessing sufficient heat capacity to serially effect upon sufficient heating thereof by the cyclic combustion of said mixture the ignition of subsequent sequential charges of fuel and air and then the absorption of sufficient heat from the flame provided by the combustion of each charge of fuel and air to extinguish the flame at a rate adequate to provide oscillating pulses of combustion gases through said discharge means at a substantially preselected amplitude and frequency.

2. A pulse combustor as claimed in claim 1, wherein said at least one elongated ceramic body is formed of alumina, fused silica, mullite, or zirconia.

3. A pulse combustor as claimed in claim 1, wherein said at least one elongated ceramic body is provided by a single ceramic body centrally located within said combustion chamber and coaxial with the longitudinally extending housing means.

4. A pulse combustor as claimed in claim 1, wherein said at least one elongated ceramic body is provided by a plurality of coaxially extending ceramic bodies.

5. A pulse combustor as claimed in claim 1, wherein heat exchange means are coupled to said at least one elongated ceramic body for the selective heating or cooling thereof.

6. A pulse combustor as claimed in claim 1, wherein heat exchange means are in contact with said side walls of said housing means for selectively cooling or heating said side walls.

7. A pulse combustor as claimed in claim 6, wherein said heat exchange means comprises jacket means disposed about said side walls for defining an annular chamber, and wherein inlet and outlet means are in registry with the annular chamber for admitting and discharging therefrom a heat exchange medium for cooling or heating said side walls.

8. A pulse combustor as claimed in claim 1, where the end wall portion opposite said one end wall portion contacts said side walls portions to enclose the combustion chamber at an end thereof opposite to said discharge means, wherein the fuel and air inlet means are in registry with said side walls at a location in the combustion chamber adjacent to the enclosed end of the combustion chamber, wherein said ignition means comprises spark plug means disposed in said side walls at a location intermediate the fuel and air inlet means and said discharge means, wherein the discharge means is a tail pipe, and wherein said at least one elongated ceramic body extends through substantially the length of said combustion chamber along a plane parallel with the longitudinal axis of said housing means.

9. A pulse combustor as claimed in claim 8, wherein jacket means are spatially positioned about said side walls for defining an annular chamber, wherein inlet means and outlet means are in registry with the annular chamber, and wherein means are in registry with said inlet means for conveying heat exchange medium into said annular chamber for cooling or heating said side walls.

* * * * *